US006428062B1

(12) United States Patent
Roehl

(10) Patent No.: US 6,428,062 B1
(45) Date of Patent: Aug. 6, 2002

(54) TRUCK LID HOLDER FOR VEHICLES

(76) Inventor: Steven G. Roehl, 1005 7th Ave. North, Princeton, MN (US) 55371

( * ) Notice: Subject to any disclaimer, the term of this patent is extended or adjusted under 35 U.S.C. 154(b) by 0 days.

(21) Appl. No.: 09/480,523

(22) Filed: Jan. 7, 2000

(51) Int. Cl.[7] ..... E05C 17/54
(52) U.S. Cl. ..... 292/339
(58) Field of Search ..... 292/263, 288, 292/338, 339, DIG. 43, DIG. 49

(56) References Cited

U.S. PATENT DOCUMENTS 598,405 A * 2/1898 Williams ..... 292/339
2,974,989 A 4/1961 Hilbers
3,180,668 A 4/1965 Brown
4,070,050 A * 1/1978 Glock et al. ..... 292/339
5,163,724 A 11/1992 Conte
5,320,398 A 6/1994 Popp et al.
D375,891 S 11/1996 Bailey et al.
5,647,619 A 7/1997 De Liso

* cited by examiner

*Primary Examiner*—Stephen Avila

(57) ABSTRACT

A trunk lid holder for vehicles for preventing the trunk lid from closing. The trunk lid holder for vehicles includes an elongate tubular member having an open end, a closed end, a mounting bracket disposed at the closed end, and a hole near the open end, and also includes a shaft slidably extended in the elongate tubular member through the open end and having a jaw-like end and a plurality of holes spaced along the length of the shaft, and further includes a slidable locking member disposed on the shaft for closing and opening the jaw-like end, and also includes a pair of bracket members securely mounted to the elongate tubular member, a stub shaft mounted to the bracket members, a spring disposed about the stub shaft, and a latching member mounted upon the shaft and being engageable with the latching member to securely lock the shaft within the elongate tubular member.

14 Claims, 4 Drawing Sheets

TRUCK LID HOLDER FOR VEHICLES

BACKGROUND OF THE INVENTION

1. Field of the Invention

The present invention relates to a support to secure an open trunk lid and more particularly pertains to a new trunk lid holder for vehicles for preventing the trunk lid from closing.

2. Description of the Prior Art

The use of a support to secure an open trunk lid is known in the prior art. More specifically, a support to secure an open trunk lid heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 3,180,668; 2,974,989; 5,647,619; 5,320,398; 5,163,724; and U.S. Pat. No. Des. 375,891.

While these devices fulfill their respective, particular objectives and requirements, the aforementioned patents do not disclose a new trunk lid holder for vehicles. The inventive device includes an elongate tubular member having an open end, a closed end, a mounting bracket disposed at the closed end, and a hole near the open end, and also includes a shaft slidably extended in the elongate tubular member through the open end and having a jaw-like end and a plurality of holes spaced along the length of the shaft, and further includes a slidable locking member disposed on the shaft for closing and opening the jaw-like end, and also includes a pair of bracket members securely mounted to the elongate tubular member, a stub shaft mounted to the bracket members, a spring disposed about the stub shaft, and a latching member mounted upon the shaft and being engageable with the latching member to securely lock the shaft within the elongate tubular member.

In these respects, the trunk lid holder for vehicles according to the present invention substantially departs from the conventional concepts and designs of the prior art, and in so doing provides an apparatus primarily developed for the purpose of preventing the trunk lid from closing.

SUMMARY OF THE INVENTION

In view of the foregoing disadvantages inherent in the known types of a support to secure an open trunk lid now present in the prior art, the present invention provides a new trunk lid holder for vehicles construction wherein the same can be utilized for preventing the trunk lid from closing.

The general purpose of the present invention, which will be described subsequently in greater detail, is to provide a new trunk lid holder for vehicles which has many of the advantages of the support to secure an open trunk lid mentioned heretofore and many novel features that result in a new trunk lid holder for vehicles which is not anticipated, rendered obvious, suggested, or even implied by any of the prior art a support to secure an open trunk lid, either alone or in any combination thereof.

To attain this, the present invention generally comprises an elongate tubular member having an open end, a closed end, a mounting bracket disposed at the closed end, and a hole near the open end, and also includes a shaft slidably extended in the elongate tubular member through the open end and having a jaw-like end and a plurality of holes spaced along the length of the shaft, and further includes a slidable locking member disposed on the shaft for closing and opening the jaw-like end, and also includes a pair of bracket members securely mounted to the elongate tubular member, a stub shaft mounted to the bracket members, a spring disposed about the stub shaft, and a latching member mounted upon the shaft and being engageable with the latching member to securely lock the shaft within the elongate tubular member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new trunk lid holder for vehicles which has many of the advantages of the support to secure an open trunk lid mentioned heretofore and many novel features that result in a new trunk lid holder for vehicles which is not anticipated, rendered obvious, suggested, or even implied by any of the prior art a support to secure an open trunk lid, either alone or in any combination thereof.

It is another object of the present invention to provide a new trunk lid holder for vehicles which may be easily and efficiently manufactured and marketed.

It is a further object of the present invention to provide a new trunk lid holder for vehicles which is of a durable and reliable construction.

An even further object of the present invention is to provide a new trunk lid holder for vehicles which is susceptible of a low cost of manufacture with regard to both materials and labor, and which accordingly is then susceptible of low prices of sale to the consuming public, thereby making such trunk lid holder for vehicles economically available to the buying public.

Still yet another object of the present invention is to provide a new trunk lid holder for vehicles which provides in the apparatuses and methods of the prior art some of the advantages thereof, while simultaneously overcoming some of the disadvantages normally associated therewith.

Still another object of the present invention is to provide a new trunk lid holder for vehicles for preventing the trunk lid from closing.

Yet another object of the present invention is to provide a new trunk lid holder for vehicles which includes an elongate tubular member having an open end, a closed end, a mounting bracket disposed at the closed end, and a hole near the open end, and also includes a shaft slidably extended in the elongate tubular member through the open end and having a jaw-like end and a plurality of holes spaced along the length of the shaft, and further includes a slidable locking member disposed on the shaft for closing and opening the jaw-like end, and also includes a pair of bracket members securely mounted to the elongate tubular member, a stub shaft mounted to the bracket members, a spring disposed about the stub shaft, and a latching member mounted upon the shaft and being engageable with the latching member to securely lock the shaft within the elongate tubular member.

Still yet another object of the present invention is to provide a new trunk lid holder for vehicles that allows the user to secure the trunk lid as tightly as possible over the cargo loaded in a trunk of a vehicle.

Even still another object of the present invention is to provide a new trunk lid holder for vehicles that would prevent the trunk lid from flying open and banging down upon the cargo.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
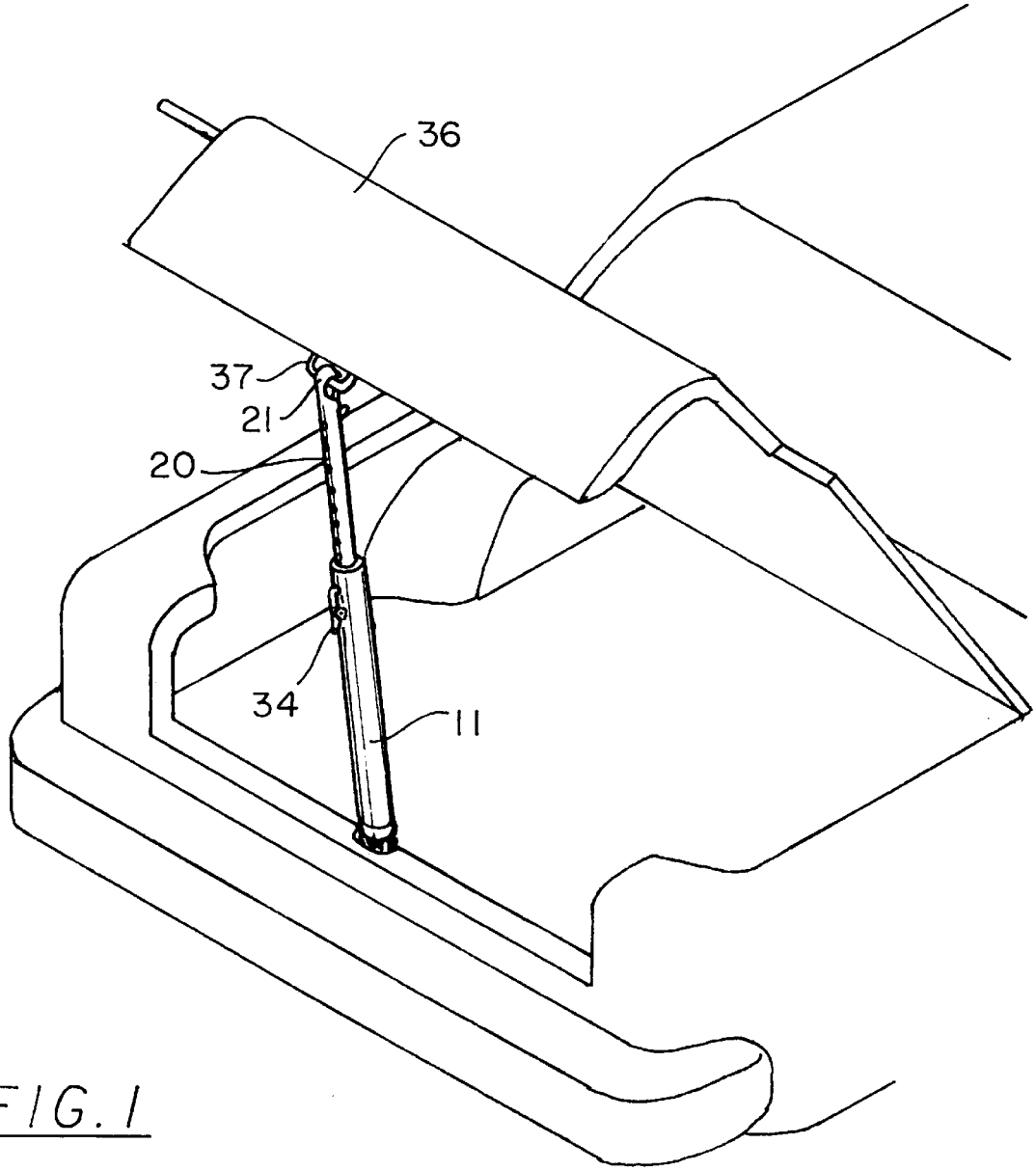
FIG. 1 is a perspective view of a new trunk lid holder for vehicles according to the present invention as shown to be in use.
Figure 2:
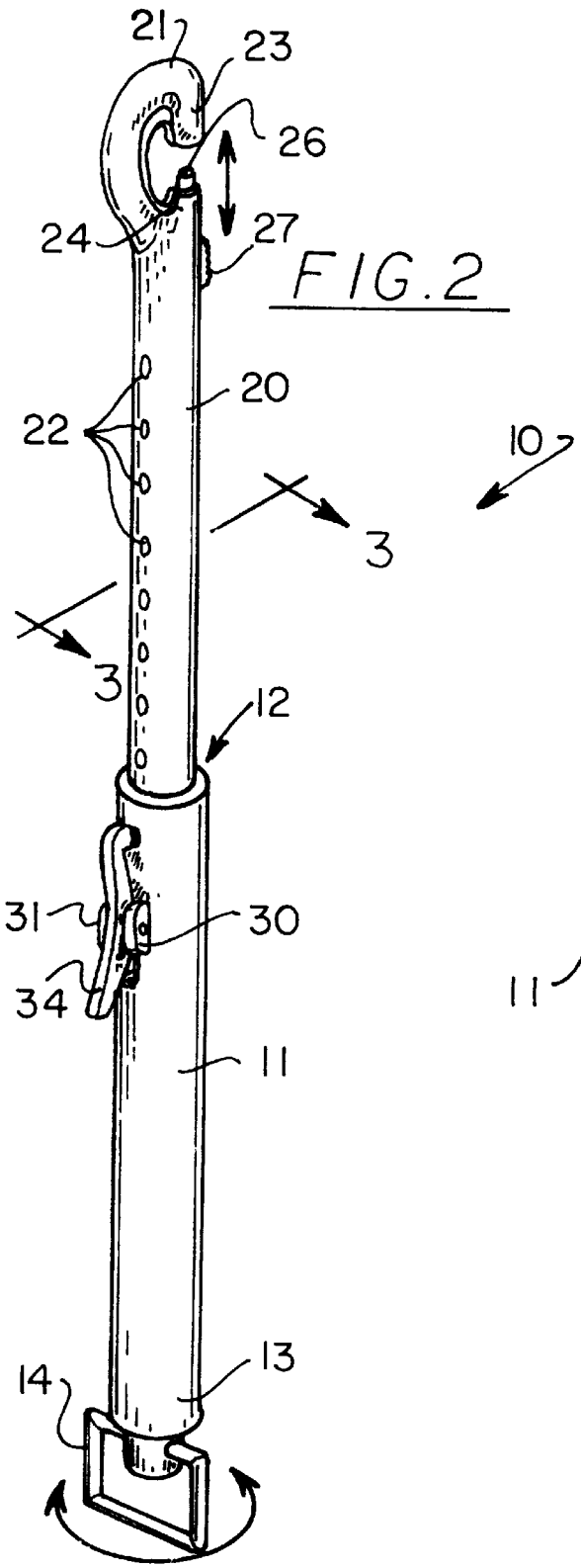
FIG. 2 is a perspective view of the present invention.
Figure 3:
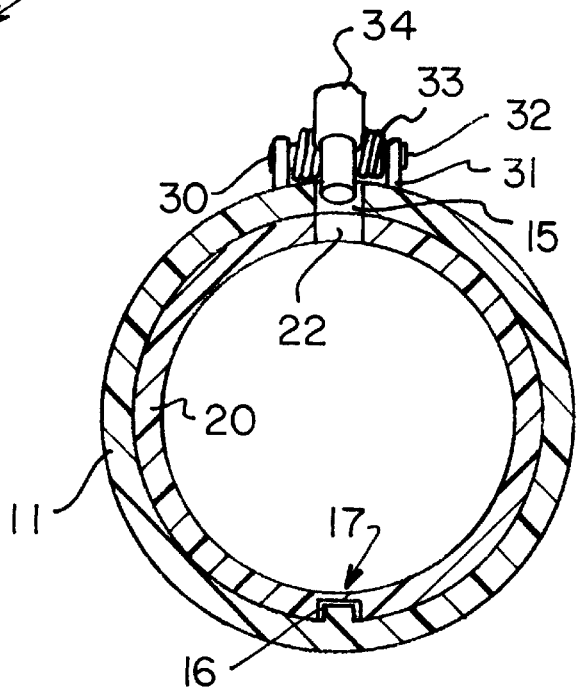
FIG. 3 is a cross-sectional view of the first embodiment of the present invention.
Figure 4:
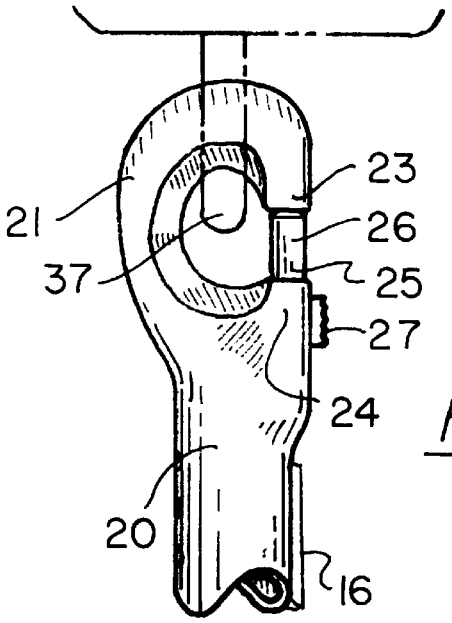
FIG. 4 is a detailed view of the jaw-like end of the present invention.
Figure 5:
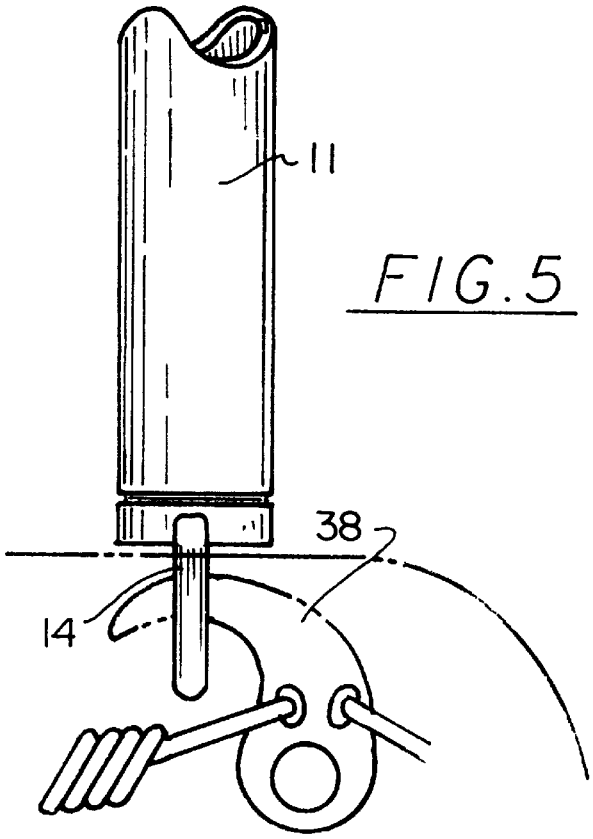
FIG. 5 is a detailed view of the closed end of the elongate tubular member of the present invention.
Figure 6:
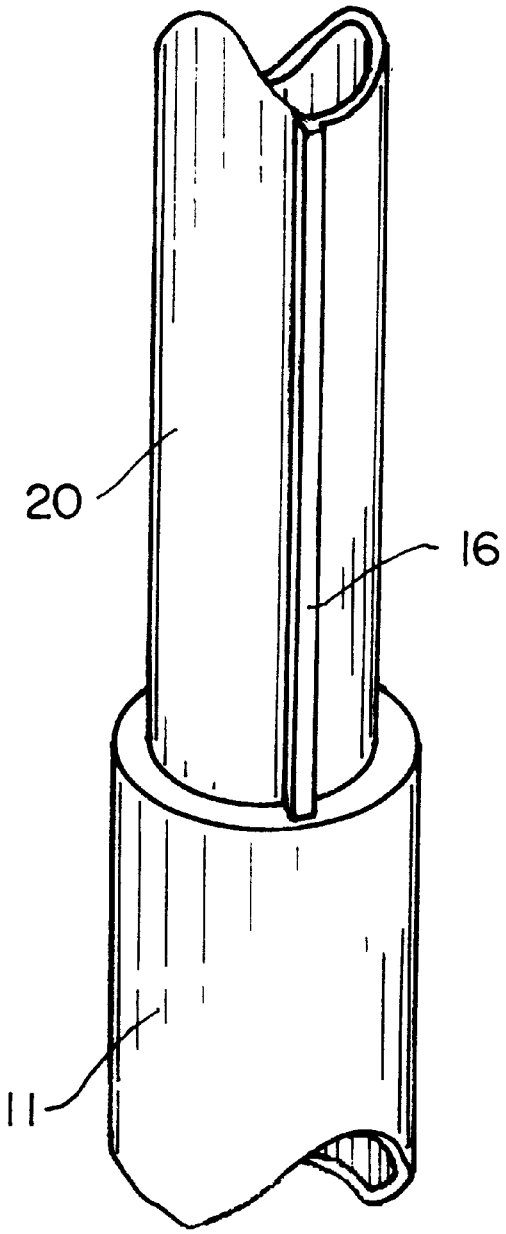
FIG. 6 is a detailed perspective view of the second embodiment of the present invention.
Figure 7:
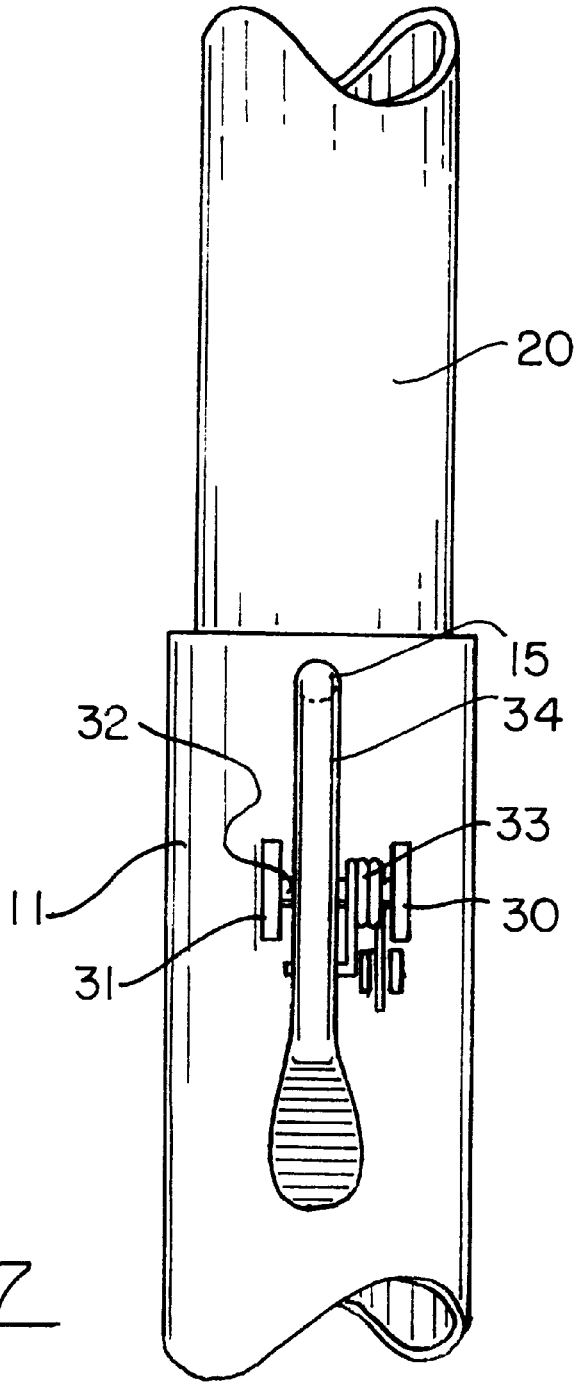
FIG. 7 is a detailed side elevational view of the present invention.

With reference now to the drawings, and in particular to FIGS. 1 through 7 thereof, a new trunk lid holder for vehicles embodying the principles and concepts of the present invention and generally designated by the reference numeral 10 will be described.

As best illustrated in FIGS. 1 through 7, the trunk lid holder for vehicles 10 generally comprises an elongate tubular member 11 having an open end 12, a closed end 13, a hole 15 disposed through a wall thereof near the open end 12, and a mounting bracket member 14 pivotally and conventionally attached at the closed end 13 thereof. The mounting bracket member 14 is essentially a ring-like member adapted to receive a trunk lid latching mechanism 38. A shaft 20 is slidably extended in the elongate tubular member 11 through the open end 12 and has a jaw-like end 21. The shaft 20 includes a plurality of holes 22 spaced therealong and extending therein and is adjustably extended outwardly of the elongate tubular member 11. The jaw-like end 21 is essentially a C-shaped structure. A slidable locking member 25 is securely and conventionally disposed upon the shaft 20 at the jaw-like end 21 for essentially opening and closing the jaw-like end 21. The slidable locking member 25 extends in a bore of the shaft 20 and includes a bolt-like member 26 and a finger control member 27 which is securely attached or welded to the bolt-like member 26. The jaw-like member 21 includes an upper jaw 22 and a lower jaw 23 spaced from the upper jaw 22. The bolt-like member 26 is adjustably moveable between the upper 22 and lower 23 jaws. A means for securing the shaft 20 to the elongate tubular member 11 includes a pair of bracket members 30,31 welded to the elongate tubular member 11, a stub shaft 32 securely mounted to the bracket members 30,31, a spring 33 mounted about the stub shaft 32, and a latching member 34 pivotally mounted to the stub shaft 32 and being engageable with the spring 33. The latching member 34 has an end which is removeably biased in the hole 15 of the tubular member 11 to essentially lock the shaft 20 at a selected position relative to the elongate tubular member 11.

As a first embodiment, the elongate tubular member 11 includes a track member 16 conventionally disposed upon an interior of the wall and extends essentially the length of the tubular member 11, and the shaft 20 includes a groove 17 extending in an exterior of the shaft 20 and extending approximately the length thereof with the groove 17 being adapted to receive the track member 16.

As a second embodiment, the shaft 20 includes a track member 11 disposed upon an exterior thereof and extending approximately the length of the shaft 20, and the elongate tubular member 11 includes a groove 17 extending in an interior thereof and extending the length thereof with the groove 17 being adapted to receive the track member 16.

In use, the user extends the shaft 20 outwardly of the elongate tubular member 11 as desired and then locks the shaft 20 at that position. The user then places the trunk lid latching mechanism 38 through the ring-like member 14 to secure the elongate tubular member 11 and then secures the jaw-like end 21 of the shaft 20 to the bracket member 37 for the trunk lid 36.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A trunk lid holder for vehicles comprising:

an elongate tubular member having an open end, a closed end, a hole disposed through a wall thereof near said open end, and a mounting bracket member pivotally attached at said closed end thereof;

a shaft slidably extended in the elongate tubular member through said open end and having a jaw-like end;

a slidable locking member securely disposed upon said shaft at said jaw-like end for essentially opening and closing said jaw-like end; and a means for securing said shaft to said elongate tubular member;

wherein said mounting bracket member is essentially a ring-like member adapted to receive a trunk lid latching mechanism;

wherein said shaft includes a plurality of holes spaced therealong and extending therein;

wherein said jaw-like end is essentially a C-shaped structure;

wherein said slidable locking member extends in a bore of said shaft and includes a bolt-like member and a finger control member which is securely attached to said bolt-like member;

wherein said jaw-like member includes an upper jaw and a lower jaw spaced from said upper jaw;

wherein said bolt-like member is adjustably moveable between said upper and lower jaws; and wherein said means for securing said shaft to said tubular member includes a pair of bracket members, a stub shaft mounted to said bracket members, a spring mounted about said stub shaft, and a latching member pivotally mounted to said stub shaft and engageable with said spring, said latching member having an end which is removeably biased in said hole of said tubular member.

2. A trunk lid holder for vehicles as described in claim 1, wherein said elongate tubular member includes a track member disposed upon an interior of said wall and extending the length of said tubular member.

3. A trunk lid holder for vehicles as described in claim 2, wherein said shaft includes a groove extending in an exterior of said shaft and extending approximately the length thereof, said groove being adapted to receive said track member.

4. A trunk lid holder for vehicles as described in claim 1, wherein said shaft includes a track member disposed upon an exterior thereof and extending approximately the length of said shaft.

5. A trunk lid holder for vehicles as described in claim 4, wherein said elongate tubular member includes a groove extending in an interior thereof and extending the length thereof, said groove being adapted to receive said track member.

6. A trunk lid holder for vehicles comprising:

an elongate tubular member having an open end, a closed end, a hole disposed through a wall thereof near said open end, and a mounting bracket member pivotally attached at said closed end thereof, said mounting bracket member being essentially a ring-like member adapted to receive a trunk lid latching mechanism;

a shaft slidably extended in said elongate tubular member through said open end and having a jaw-like end, said shaft including a plurality of holes spaced therealong and extending therein, said jaw-like end being essentially a C-shaped structure;

a slidable locking member securely disposed upon said shaft at said jaw-like end for essentially opening and closing said jaw-like end, said slidable locking member extending in a bore of said shaft and including a bolt-like member and a finger control member which is securely attached to said bolt-like member, said jaw-like member including an upper jaw and a lower jaw spaced from said upper jaw, said bolt-like member being adjustably moveable between said upper and lower jaws; and a means for securing said shaft to said elongate tubular member including a pair of bracket members, a stub shaft mounted to said bracket members, a spring mounted about said stub shaft, and a latching member pivotally mounted to said stub shaft and engageable with said spring, said latching member having an end which is removeably biased in said hole of said tubular member.

7. A trunk lid holder for vehicles as described in claim 6, wherein said elongate tubular member includes a track member disposed upon an interior of said wall and extending the length of said tubular member.

8. A trunk lid holder for vehicles as described in claim 7, wherein said shaft includes a groove extending in an exterior of said shaft and extending approximately the length thereof, said groove being adapted to receive said track member.

9. A trunk lid holder for vehicles as described in claim 6, wherein said shaft includes a track member disposed upon an exterior thereof and extending approximately the length of said shaft.

10. A trunk lid holder for vehicles as described in claim 9, wherein said elongate tubular member includes a groove extending in an interior thereof and extending the length thereof, said groove being adapted to receive said track member.

11. A trunk lid holder for vehicles comprising:

an elongate tubular member having an open end, a closed end, a hole disposed through a wall thereof near said open end, and a mounting bracket member pivotally attached at said closed end thereof;

a shaft slidably extended in the elongate tubular member through said open end and having a jaw-like end;

a slidable locking member securely disposed upon said shaft at said jaw-like end for opening and closing said jaw-like end; and a means for securing said shaft to said elongate tubular member;

wherein said mounting bracket member comprises a ring member adapted to receive a trunk lid latching mechanism, said ring member being pivotable with respect to said tubular member;

wherein said means for securing said shaft to said tubular member including a pair of bracket members, a stub shaft mounted to said bracket members, a spring mounted about said stub shaft, and a latching member pivotally mounted to said stub shaft and engageable with said spring, said latching member having an end which is removeably biased in said hole of said tubular member.

12. A trunk lid holder for vehicles as described in claim 11, wherein said ring member pivots about an axis oriented parallel to a longitudinal axis of said tubular member.

13. A trunk lid holder for vehicles as described in claim 11, wherein said ring member is pivotable about an axis oriented perpendicular to a longitudinal axis of said tubular member.

14. A trunk lid holder for vehicles as described in claim 11, wherein said ring member pivots about an axis oriented parallel to a longitudinal axis of said tubular member and also about an axis oriented perpendicular to a longitudinal axis of said tubular member.

* * * * *

UNITED STATES PATENT AND TRADEMARK OFFICE

CERTIFICATE OF CORRECTION

PATENT NO. : 6,428,062 B1
DATED : August 6, 2002
INVENTOR(S) : Steven G. Roehl

It is certified that error appears in the above-identified patent and that said Letters Patent is hereby corrected as shown below:

Title page,
Item [54], Title of the Invention reading "TRUCK LID HOLDER FOR VEHICLES" should read -- TRUCK LID HOLDER FOR VEHICLES --

Signed and Sealed this

Fourteenth Day of January, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,428,062 B1
DATED : August 6, 2002
INVENTOR(S) : Steven G. Roehl

It is certified that error appears in the above-identified patent and that said Letters Patent is hereby corrected as shown below:

Title page,
Item [54], Title of the Invention reading "TRUCK LID HOLDER FOR VEHICLES" should read -- TRUNK LID HOLDER FOR VEHICLES --

This certificate supersedes Certificate of Correction issued January 14, 2003.

Signed and Sealed this

First Day of April, 2003

JAMES E. ROGAN
*Director of the United States Patent and Trademark Office*